US005617613A

United States Patent [19]

Ripley

[11] Patent Number: 5,617,613

[45] Date of Patent: Apr. 8, 1997

[54] SYSTEM FOR PRODUCING A BLEACHED COTTON, NONWOVEN WEB

[76] Inventor: William G. Ripley, 4218 88th St., Lubbock, Tex. 79423

[21] Appl. No.: 637,221

[22] Filed: Apr. 24, 1996

Related U.S. Application Data

[63] Continuation-in-part of Ser. No. 405,755, Mar. 20, 1995, which is a continuation of Ser. No. 116,740, Sep. 7, 1993, Pat. No. 5,425,158, which is a continuation-in-part of Ser. No. 950,272, Sep. 24, 1992, Pat. No. 5,253,392, and a continuation of Ser. No. 612,558, Nov. 13, 1990, Pat. No. 5,199,134.

[51] Int. Cl.[6] ..... D01G 21/00

[52] U.S. Cl. ..... 19/66 CC; 19/66 R; 19/200; 19/98; 19/115 R; 19/145.5; 19/65 A

[58] Field of Search ..... 19/115 R, 98, 19/65 A, 65 R, 66 R, 66 CC, 80 R, 144, 145, 145.5, 145.7, 200, 201, 204, 205, 296, 302, 304, 297, 105, 0.27, 150, 151; 28/103, 104

[56] References Cited

U.S. PATENT DOCUMENTS

| | | | |
|---|---|---|---|
| 3,493,452 | 2/1970 | Cole | 19/296 |
| 3,802,030 | 4/1974 | Acree | 19/66 CC |
| 4,019,225 | 4/1977 | Nayfa | 19/66 R |
| 4,718,152 | 1/1988 | Suzuki et al. | 28/104 |
| 4,944,070 | 7/1990 | Girard et al. | 19/66 CC |
| 5,038,438 | 8/1991 | Gunter | 19/65 A |
| 5,155,989 | 10/1992 | Frey et al. | 19/65 A |
| 5,205,018 | 4/1993 | Leifeld et al. | 19/145.5 |
| 5,224,243 | 7/1993 | Schlepfer et al. | 19/205 |

*Primary Examiner*—Michael A. Neas
*Attorney, Agent, or Firm*—Henry S. Jaudon; Cort Flint

[57] ABSTRACT

A continuous textile processing system and method are disclosed for producing a nonwoven web containing bleached cotton fibers in a single line system which includes a supply of fibers such as a bale opening device, a plurality of fiber delivery lines transport the fibers through a fiber opening process where the fibers are individualized and opened. The opened fibers are collected and fed through a blending system. The blended fibers are passed to a continuous flow bleaching unit comprised of a forming station and a bleachery. The bleached web is passed through a drier unit. The dried web is subjected to further processing which includes carding machines forming a blended fiber web and a hydroentangling machine stabilizing the web. The web is then rolled and readied for other processing. The final nonwoven web consisting of bleached cotton fibers may be made into highly purified and absorbent wipes, pads, and other articles for medical, industrial, or domestic use.

19 Claims, 2 Drawing Sheets

SYSTEM FOR PRODUCING A BLEACHED COTTON, NONWOVEN WEB

This is a continuation in part of application Ser. No. 08/405,755 filed on Mar. 20, 1995 which is a continuation of application Ser. No. 08/116,740 filed Sep. 7, 1993, now U.S. Pat. No. 5,425,158, which is a continuation in part of application Ser. No. 07/950,272 filed Sep. 24, 1992 now U.S. Pat. No. 5,253,392 and a continuation application Ser. No. 07/612,558 filed Nov. 13, 1990 now of U.S. Pat. No. 5,199,134.

BACKGROUND OF THE INVENTION

The invention relates to a continuous, fully integrated system and method for producing nonwoven webs consisting of bleached cotton fibers.

Bleached cotton fibers have been used in many nonwoven fabric applications for cleanliness and absorbency such as wipes, pre-moistened towelettes, absorbent pads, etc.. The purified, absorbent fibers are particularly advantageous in hospital and medical applications such as disposable sheets, blankets, gowns, and bandages, and, particularly, because of their biodegradability. Typically the bleached cotton fibers are made into a nonwoven web and then fabricated for the particular end use.

The typical process has included many separated processing steps. Typically, raw cotton fibers are bleached at a remote bleachery using a large vat. The bleached fibers are dried and pressed into bales. The bales of bleached cotton fibers are then transported to a textile mill at another location where they are processed further by a nonwoven carding system into nonwoven webs in a conventional manner. Bleaching processes have not been a part of nonwoven textile processing lines. As a result, the textile process has been fairly inefficient incurring transportation costs, and inefficiency through piecemeal processing.

Various textile process lines for woven and nonwoven fabrics are known and have been proposed in the past. Various processes and systems are known for opening, cleaning, and blending fibers, for example, U.S. Pat. No. 2,718,671. Various processes and systems for opening fiber bales, and opening and cleaning the fiber before being carded into a web for woven or nonwoven applications are known, for example, as shown in U.S. Pat. No. 4,535,511.

It is known to make webs formed from synthetic fibers more integral by hydroentanglement techniques. Various hydroentanglement techniques and apparatus for producing integral webs having various patterns are shown in U.S. Pat. Nos. 3,494,821; 3,486,168; 3,485,706; 3,508,308; and 3,493,462.

Because of the increased demand for the bleached cotton fiber, for both woven and nonwoven products, it has become necessary to use lower grades of cotton. This has rendered the prior bleaching and textile processes unsatisfactory because they do not satisfactorily process the lower grade of cotton.

Accordingly, an important object of the present invention is to provide a system and method for producing bleached cotton, nonwoven webs in a single processing line under one roof.

Another object of the invention is to provide a continuous fiber preparation process capable of converting low grade, dirty, short stable cotton fibers into a clean blended fiber web.

Another important object of the invention is to provide an efficient textile process system and method which begins with the opening of raw cotton fibers from bales and ends with the production of nonwoven webs ready to enter a cotton bleaching process in a continuous system.

Another object of the invention is to provide a continuous cleaning cotton system which dries the cotton fibers prior to cleaning so as to more efficiently and effectively remove trash and dirt particles.

Another object of the invention is to provide a continuous cotton cleaning system capable of adapting between clean extremely dirty cotton and mildly dirty cotton.

Another object of the invention is to provide a textile processing system and method wherein low grade raw cotton fibers may be processed and bleached and the bleached fibers may be subjected to further processing and production of a nonwoven web and prepared for further textile processing.

Another object of the invention is to provide a cotton processing system capable of producing cleaned and bleached cotton at an extremely high yield.

Another object of the invention is to provide a cotton processing system which reduces the cost per pound of processing clean and bleached cotton.

Another object of the invention is to produce surgical grade cleaned and bleached cotton at a rate of at least three thousand pounds per hour.

Another object of the invention is to provide a system which fully cleans and blends low grade cotton for the formation of cotton webs to be bleached.

SUMMARY OF THE INVENTION

A continuous fiber processing system for producing a bleached and blended cotton fiber web beginning with bale opening means for opening bales of cotton fibers and delivering the fibers to a plurality of fiber feed lines each of which includes a first fiber opening means for individualizing and cleaning the fibers to produce cleaned opened fibers. From the opening means the fibers move to a fiber preparation station which includes a fiber heating unit and a metal removing unit for collecting the opened fibers and preparing them for blending, cleaning and web forming. Conveyor means deliver the fibers from the preparation station to a precleaning station. The precleaning station cools, cleans and re-heats the fibers for presentation to the primary cleaning and web forming station. The primary cleaning and web forming station further cleans, blends and forms the fibers into a web. The fiber web is delivered to a cross-blending station which prepares the web for delivery to the bleaching station.

The pre-cleaning station includes a horizontal cleaning machine which allows the fibers to cool and also inclined cleaning machines.

The primary cleaning and web forming station includes a stick and large trash removing machine, inclined cleaning machines, micro dust removing machines, double battery comber machines and in line comber machines.

Switching gates are provided which allow selective delivery of the cotton fibers to selected stations.

The primary cleaning and web forming station includes a web divider which separates the web to feed the double battery combing machines simultaneously.

The bleaching station includes a web forming section which forms a web and delivers it to a continuous flow bleaching system which bleaches the fibers forming the web producing a web of bleached cotton fibers. From the bleaching system, the web is fed into a dryer system for drying. From the dryer system the now dried bleached web goes to a slitter which slits same into a plurality of web strips or slivers. The slivers are fed to a plurality of carding machines which further blend and clean the fibers and also forms them into a loose web. The loose webs are delivered to a common conveyor means in stacked overlaying fashion forming a stacked web. The common conveyor delivers the stacked bleached web to a second web stabilizing means in the form of a hydroentangling system which produces a stable web of entangled fibers. The stable web is passed to a second dryer mechanism and from there to roll forming means where it is rolled into a web for use in further fiber processes.

The web forming section of the bleaching station includes a pair of cross blenders arranged side-by-side and two pair of opposed carding machines supplied from the cross blenders through chute feeds. The opposed carding machines are interconnected with a pair of cross lappers which deliver a cross lapped and stacked multi-layer web onto a conveyor. The conveyor delivers the stacked web through a web stabilizing device which forms a stabilized web which is delivered into a series of bleacheries.

The first dryer system comprises a foam dryer for receiving and treating the bleached web from the fiber bleaching means and a web drying oven for receiving the web from the foam drying means. Also, there may be included apparatus for applying an additive to the bleached cotton fibers before they are dried as they exit the fiber bleaching means. Additionally, means for dying the bleached and hydroentangled web a desired color may be provided.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DETAILED DESCRIPTION OF A PREFERRED EMBODIMENT

Figures 1, 1A:
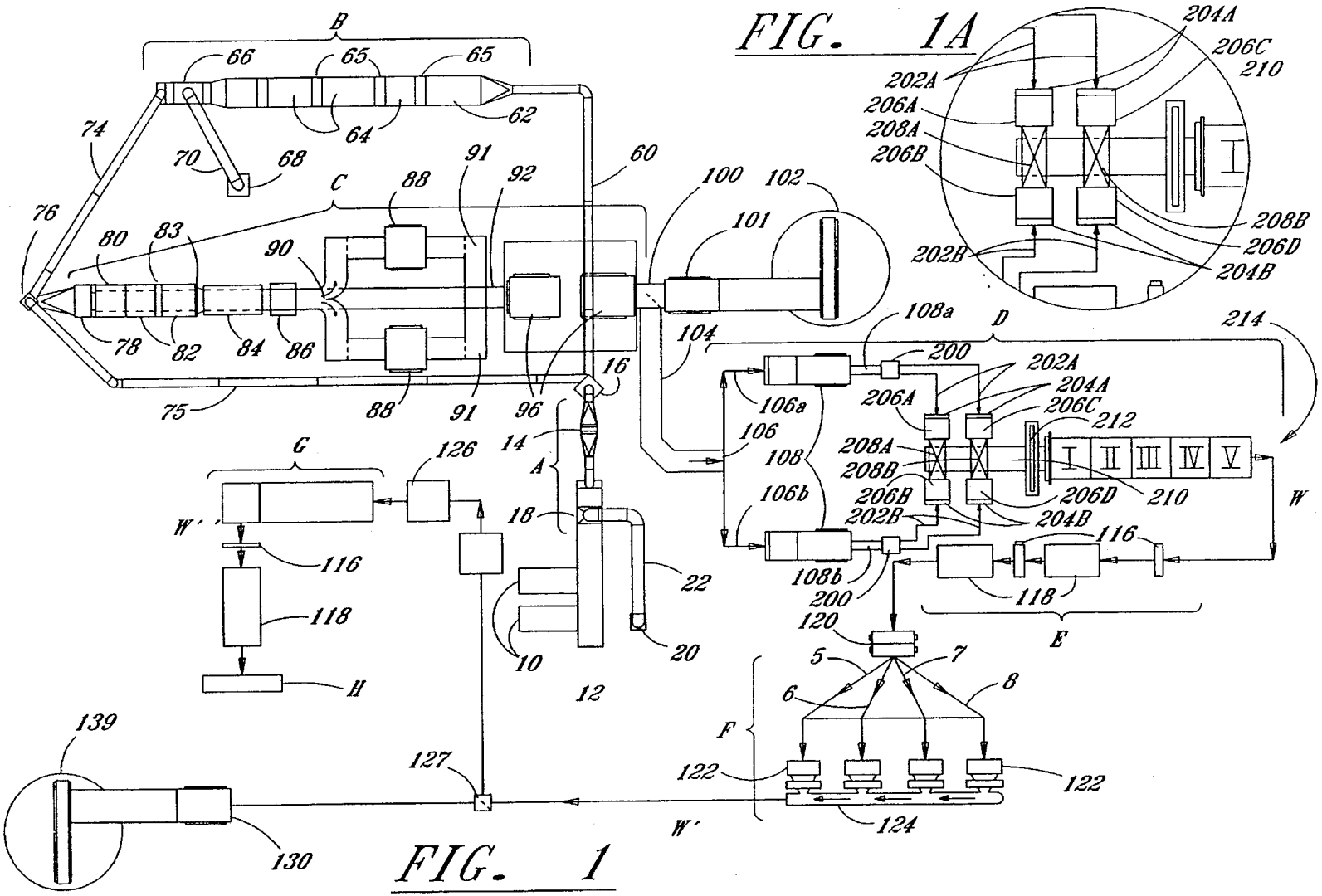
FIG. 1 is a schematic view illustrating a textile processing system and method for producing a non-woven web of cleaned cotton, prepared for delivery to a bleaching operation in a single and continuous processing line.
FIG. 1*a* is an exploded sectional view showing the web forming section of bleaching station D.

Referring now in more detail to the drawings, a system and method for producing a nonwoven web of cleaned and bleached cotton fibers will be described. As shown in FIG. 1, the system begins with a delivery line which is connected with at least two bale openers 10 which may be any suitable and known type such as a HF6012 hopper feeder manufactured by Hollingsworth, Inc. of Greenville, S.C. Bale openers 10 are each capable of opening up to four bales per hour. Fibers from bale openers 10 are discharged onto a mechanical conveyor 12 and delivered to a preliminary cleaning station A. Preliminary station A includes a preheat chamber which removes moisture from the fibers and readies them for particle and dust removal. From the pre-heating chamber 18, fibers go into a metal removing unit 14 which cleans and removes metal and begins the process of opening and further individualizing the fibers. Any suitable metal removing unit may be used such as manufactured by continental, Hollingsworth or Lumas. Fibers are conveyed from metal remover 14 into y-valve 16 which controls the degree of additional cleaning and web forming processes performed on the fibers between an intensive cleaning process and a super intensive cleaning process as they are processed toward bleaching unit D.

Reference is made to co-pending application Ser. No. 08/405,755 and U.S. Pat. No. 5,235,392 which describe in detail the structure of pre-heating chamber 18, which description is incorporated herewith.

A conduit conveys the heated fibers from pre-heating chamber 18 into the metal removing station 14. From this station the fibers leave preliminary station A and pass to "y" valve 16.

If it is necessary that a super intensive cleaning operation be conducted, valve 16 directs the heated fibers carried by the heated air into conduit 60 which delivers them to pre-cleaning station B. Pre-cleaning station B consist of a horizontal cleaner 62 into which the fibers are delivered by conduit 60. In line with and adjacent to the horizontal cleaning machine 62 are a plurality of inclined cleaners 64, preferably three. Cleaners 62 and 64 further clean condition and blend the fibers. They also allow the fibers to cool.

Upon leaving the last inclined cleaner 64, the fibers are again pass through a heating station 66 which is similar to heating station 18.

Heat source 68 delivers heated air through conduit 70 into heating station 66 where it further heats blends, cleans and conveys the fibers into and through conduit 74. Conduit 74 terminates with a y valve 76 which leads to primary cleaning and web forming station C.

Primary cleaning and web forming station C begins with a stick and large trash removing cleaning machine 78 which again cleans the fibers of large particles. From cleaning machine 78 the fibers are delivered to a comber machine 80 which cleans and aligns the fibers and forms them into a batt. The fiber batt is delivered to the first of a series of in line inclined cleaners 82 which break up the fiber batt and further blend and clean the fibers. To assist in maintaining the fibers separated for cleaning, each of the inclined cleaner 82 delivers the fibers into a fiber drop 83 which allow the fibers to free fall before being delivered to the next inclined cleaner. Following the series of inclined cleaners 82 the fibers are passed through a fine trash removal machine 84 followed by a micro dust removing machine 86.

The fibers upon leaving the micro dust remover 86 are passed through a splitter 90 which divides the fibers along two paths. Adjacent to splitter 90 is a double battery comber 88. The divided fibers are delivered into double stacked comber 88 where they are combed and formed into webs. The webs are delivered onto conveyor 91 which stacks them in vertical fashion on conveyor 92. Conveyor 92 delivers the stacked web into a first of the in line combers 96 where the fibers are again combed and formed into a single web.

Y valve 100 receives the web from the last of comber machines 96. This y valve is connected in one direction with a condenser 101 which condenses the web and delivers it to a baler 102 which forms a bale of the fibers for storage before further processing as described in the referred to co-pending application.

Alternatively, y valve 100 connects with conduit 104 which delivers the fiber web to bleaching station D.

Conduit 104 connects with the web forming station of the bleaching station. The web forming station includes a switch box 106 which divides the web between a pair of cross blenders 108 or it may act to switch the web back and forth in a selected sequence between plural fiber blending machines which includes at least two cross blenders 108. The number of cross blenders 108 is determined by the volume of fibers being fed. Cross blenders 108 may be any suitable fiber blenders such as LCB lay down cross blenders manufactured by Hollingsworth, Inc. The cross blenders again blend the fibers while providing some additional fiber opening, and act as a reserve for feed feeding lines 108*a*, 108*b*. The fibers passing through feeding lines 108*a* are delivered to splitter or flow distributor 200 which acts to equalize the fiber flow and to deliver the blended fibers through conduits 202*a* to chute feeds 204*a*.

Likewise fibers coming out of the other cross blender 108 are carried by feed line 108*b* to a second splitter 200 where the fibers are equally divided and delivered to chute feeds 204*b* by conveyor lines 202*b*.

Chute feeds 204*a* and 204*b* provide another system in which small particles and micro dust are further separated from the fibers. From chute feed 204*a*, the fibers are delivered into a pair of carding machines 206*a* and *c* and from chute feed 204*b* the fibers are delivered to a pair of carding machines 206*b* and *d*. Carding machines 206*a–d* act to align the fibers while cleaning any remaining debris as they form the fibers into four webs.

Fiber webs emerging from opposing carding machines 206*a, b* are fed through cross lapper 208*a* where they are lapped and deposited onto conveyor belt 210. The carded webs emerging from carding machines 206*c*, 206*d* are delivered to cross lapper 208*b* where they are cross lapped and deposited also onto conveyor 210 and onto the previously deposited webs, forming a four ply web.

Conveyor belt 210 carries the four ply web through needle punch machine 212 which is the last phase of the web forming section. Needle punch machine 212 acts on the four ply web in a usual manner to form a stable needled fiber batt.

Conveyor belt 210 after passing through needle punch machine now moves the stabilized fiber batt or web formed by the needle punch machine into bleaching unit 214 of bleaching station D.

Bleaching unit 214 comprises a plurality of bleaching chambers I, II, III, IV, and V through which the fiber batt or web passes via a plurality of rolls (not shown) and is immersed in various bleaching agents. The bleaching agents in the various chambers may be one or a combination of alkali impregnation, alkali steam reaction, alkali reuse, bleach impugn, bleach steam, or bleach venue. A suitable bleaching unit D is a continuous flow bleaching unit manufactured by Greenville Machinery of Greenville, South Carolina. The bleaching unit bleaches the fibers as they continuously flow through the bleaching unit in web form. A bleached fiber web W leaves bleaching unit D and passes into dryer system E. Dryer system E may include foam dryer 116 which applies a flame or mildew retardant to the fibers while still wet. The web may then pass to a gas dryer 118 which can be a conventional gas fired textile oven operating at necessary speed and temperature to accommodate 4000 pounds per hour of fiber web. Dryer 118 may dry completely web, in which case the web passes directly to slitter 120. Optionally, web W may be partially dried and passed to a second foam dryer 116 which also dyes the web a solid color. From dryer 116, web W passes into a second gas dryer 118 where drying is completed. Dried web W passes now to slitting and web forming station F. Slitter 120 which receives the web from dryer 18, slits the web into a plurality of web strips or slivers 5, 6, 7, 8. Slivers or web strips 5, 6, 7, 8 are each delivered to a carding machine 122 by delivery lines. There are four cards 122 shown, however, the number may be increased or decreased depending upon the fiber pounds per hour delivered from slitter 120. Also, the number of slitters 120 may be increased if necessary. Each card 122 delivers a fiber web to mechanical conveyor 124 where the webs are lapped or stacked so as to again further blend the bleached fibers. The carded webs formed from web strips 5, 6, 7, 8 are now formed into bleached and stacked web W'. It is noted that the carding process performed by carding machines 122 removes any remaining minute particles of trash, micro dust, and also fibers which are too short. Cards 122 perform the final cleaning operation for the fibers prior to their being delivered for further product processing. The carded webs may be cross lapped and stacked by conventional cross lapping machines prior to being lapped on conveyor 124. The bleached cross lapped cotton web W' is then fed to a hydroentanglement unit G which intermingles and interlocks the fibers together in an integral web W" of bleached cotton fibers. Prior to being hydoentangled web W' may first pass through an additional card machine 125 and cross lapping machine 126 for even further cleaning and blending. The hydroentangled web is passed to dryers 116 and 118. After drying by dryers 116 and 118, web W" is formed into a roll on take-off mechanism 130 and is in condition to be handled for further applications or to be fabricated into various end products.

A suitable hydroentanglement unit is manufactured by Honeycomb Systems of Maine. As the web enters the hydroentanglement unit, it encounters a series of very fine water jet units that pierce the carded web and cause the fibers to be intermingled and interlocked. This action holds the web together. Hydroentanglement is a rather unique process which provides softness and the drapeability to the web, and a generally lint free web. The finished product is dirt, dust, and lint free, and therefore, can be used in a lot of advantageous applications, such as with instruments or electronics, in hospitals, and other non-woven markets.

Figure 2:
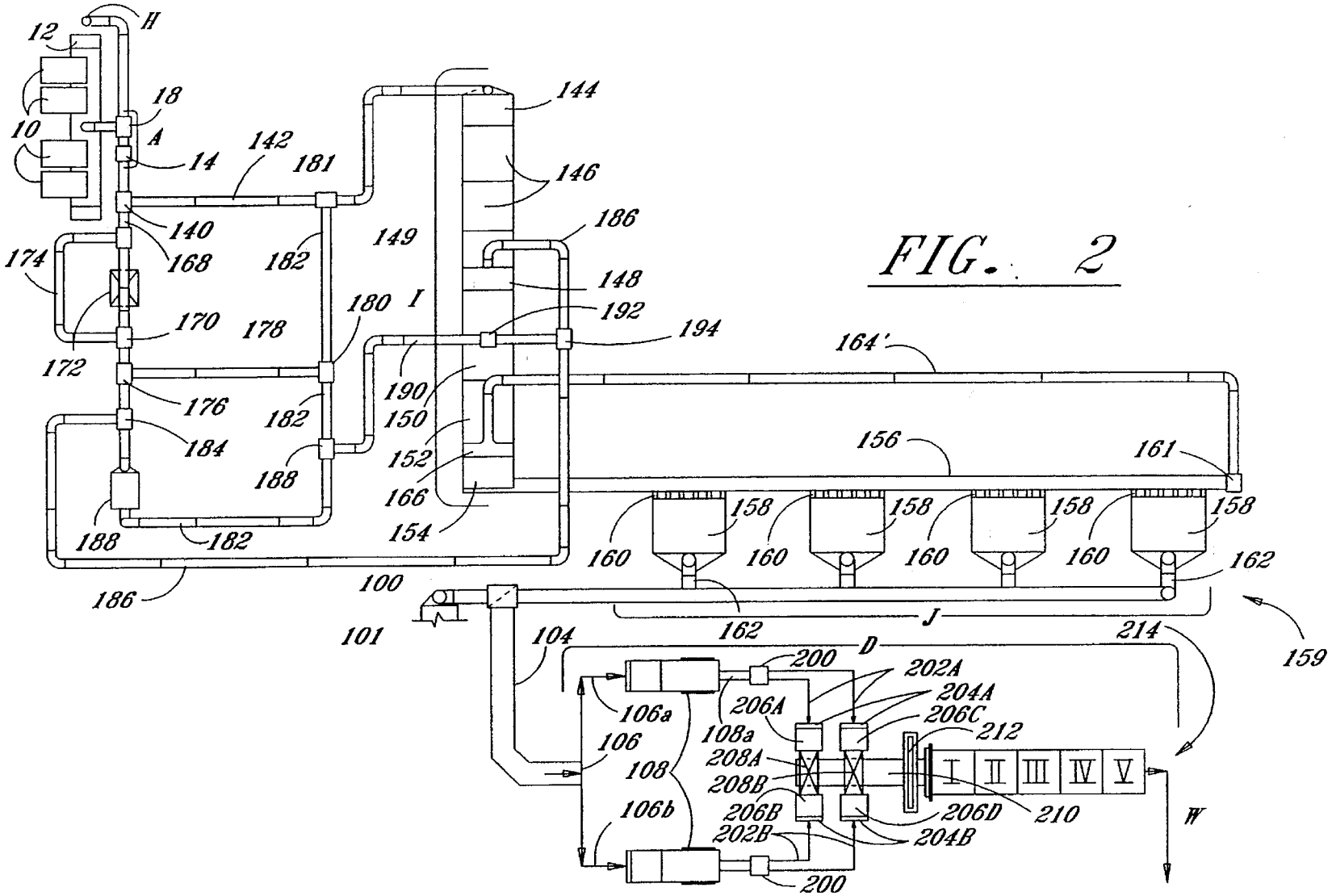
FIG. 2 is a schematic view illustrating a second processing system and method for producing a non-woven web of cleaned cotton, prepared for delivery to a bleaching operation in a single continuous processing line.

An alternative arrangement for preparing cotton fibers for bleaching and further treatment is shown in FIG. 2. In this arrangement openers 10 again open and separate cotton fibers from bales and deliver these fibers into a chute feed 12 which delivers them to a fiber preliminary station A. The number of openers 10 is totally dependent upon needs of the remainder of the system and the capacity of each opener.

From preliminary station A, the fibers are conveyed by hot air through a conduit which connects with a Y valve 140. A conduit 142 leading from valve 140 connects with a primary cleaning area I.

Primary cleaning area I consist of a condenser 144 which condenses the heated fibers and delivers them into the first of a series of at least three inclined cleaners 146 which act to blend and separate the condensed fibers allowing dust, dirt and foreign objects to be drawn away. Following this series of inclined cleaners 146 another condenser 148 is arranged to again condense the fibers before feeding them into a final inclined cleaner 150. Inclined cleaner 150 delivers the cleaned fibers into an even feed machine 152 which evenly delivers the fibers to a condenser 154.

A fine cleaning section J which includes a fiber feed apparatus comprising an auger conveyor or screw conveyor 156 is arranged to receive the condensed opened and cleaned fibers from condenser 154. Auger conveyor 156 is of usual construction consisting of an elongated tube or casing in which rotates an elongated screw. Arranged along the length of and connected with auger convey 156 are a series of carding stations 159, to be hereinafter described in detail.

The cleaned fibers are delivered into the auger conveyor from condenser 154 and are moved along the length thereof in the direction of the arrow towards overflow bin 161. Chute feed systems 160 are connected with auger conveyor 156 and are adapted to receive the opened and cleaned cotton fibers through openings in the auger casing. Should the volume of cleaned and opened fibers exceed the capacity of chute feeds 160, auger conveyor 156 simply pushes these fibers out of its opposite end and into overflow bin 161. An air current removes the excess fibers from the overflow and carries them through conduit 164' back to over flow separator 166 which recirculates the fibers back into condenser 154 where they are recirculated through auger conveyor 156.

Carding stations 159 consist of a chute feed 160 which receives fibers from auger conveyor 156 and delivers them into carding machines 158. It should be noted that each carding machine can process up to 1600 lbs per hour and that the number of carding stations 159 in the system is variable dependant upon the capacity of the further processing system.

The carding machines 158 receive opened and air born fibers from the chute feed 160. The carding machines card act to align the fibers which further removes particles and allows micro dust to fall away. The carded webs are drawn away from carding machines 158 by pneumatic suction members 162 and are delivered into conduit 164 as loose fibers in web form. Conduit 164 is connected with Y valve 100 which as earlier described is connected with conduit 104 which delivers the fiber web to bleaching station D through switch box 106. Bleaching station D as earlier described includes a web forming section which further cleans and blends the fibers before forming them into a stabilized web at needle punch machine 212 just prior to delivery into the bleacher. Valve 100 is also connected with condenser 101 which delivers the fibers to a baler such as 102 of FIG. 1.

Between preliminary station A and fine cleaning station J there are many variable routes through which the heated and opened fibers may be passed. The route selection is made in dependence upon the quality of the baled cotton to include its cleanness and the intended end use for the processed cotton fibers. A very high grade of clean cotton fibers clearly do not require an intensity of cleaning as do fibers from lower grade and less clean bales.

The fibers leaving preparation station A move through valve 140 which is normally connected with conduits 142 as previously described. Should either additional or less cleaning be desirable, valve 140 is opened to connect with conduit 168.

Valves 170 which are arranged on each side of drying chamber 172 receive fibers through conduit 168 and deliver them to or around the drying chamber via conduit 174.

Conduit 178 connects with conduit 182 via valve 176 which is arranged adjacent to but beyond valves 170 and valve 184. Conduit 178 connects with valve 176 and valve 180. Valve 184 in one position is connected with stick and leaf removing and opening chamber 188 and in another position with conduit 186.

Chamber 188 delivers fibers into conduit 182 which is connected to conduit 190 by valve 188', to conduit 178 by valve 180 and to conduit 142 by valve 181.

Conduit 190 is connected with even feed 150 of primary cleaning station I by valve 192 and with conduit 186 by valve 194. Conduit 186 is also connected with condenser 148 at 149 of primary cleaning station I.

Fibers leaving preliminary station A may be sent through a myriad of cleaning combinations because of the network of conduits and valves as described above. This gives the cleaning system a maximum of flexibility to handle cotton fibers of a wide range of staple lengths and degree of cleanness and to produce a product cleaned to the degree desired.

A few examples of fiber routes after leaving preliminary station A will now be described. The fibers normally leave station A and pass to primary cleaning unit I via conduit 142. Extra cleaning may be provided by passing the fibers first through drying chamber 172, stick and leaf cleaner 188 and then to primary cleaning unit I via conduits 182, 142 using valves 188', 180 and 181 Only a portion of primary cleaning unit I may be used by selecting to deliver the fibers through conduit 190, 186 and to primary cleaner I at 149. Even less of the primary cleaning unit may be used by moving the fibers through conduit 190 and directing them into even feed 150 by valve 192.

It is noted that in their embodiment no matter the degree of primary cleaning selected, the fibers are always fed from the primary cleaning station I to the fine cleaning station J.

Again various fiber processing machines are of themselves old and may be purchased from various manufacturers as earlier noted.

While preferred embodiments of the invention have been described using specific terms, such description is for illustrative purposes only, and it is to be understood that changes and variations may be made without departing from the spirit or scope of the following claims.

What is claimed is:

1. A continuous fiber processing system for producing a bleached and blended cotton fibers comprising:

a preliminary cleaning station;

a primary cleaning station;

a bleaching station;

further processing and cleaning stations;

a plurality of fiber delivery lines for receiving fibers from and delivering fibers to said stations;

a first of said fiber delivery lines receiving a web of cleaned and blended fibers from said primary cleaning station and delivering said web to said bleaching station;

said bleaching station including a web forming section and a bleachery;

said web forming section including cross blenders which receive said web from said first delivery line and clean and blend said fibers;

said web forming section further including a plurality of chute feed devices which are each connected with a carding machine;

a conveying device arranged to receive carded fibers from said carding machines in lapped fashion;

a needle punch machine, said conveying device being operative to deliver said lapped carded fibers through said needle punch machine, said needle punch machine forming said fibers into a continuous stable fiber web;

said conveying device delivering said stable fiber web to said bleaching chambers, said bleaching chambers bleaching said stable fiber web in a continuous process;

conveying means removing said bleached fiber web from a final of said bleaching chambers and delivering said bleached fiber web to a dryer system which dries said bleached fiber web;

conveying means connecting said dryer system with further processing apparatus;

said conveying means delivering said bleached and dried fiber web to said further processing apparatus for further processing.

2. The system of claim 1 wherein said further processing apparatus includes a slitter receiving said bleached web and forming a plurality of slivers therefrom.

3. The system of claim 2 wherein said further processing system includes a plurality of carding machines receiving and carding said slivers into carded webs and web stacking means stacking said carded webs and forming a stacked continuous web.

4. The system of claim 1 wherein said further processing system includes a hydroentangling unit, said hydroentangling unit stabilizing said bleached web.

5. The system of claim 1 wherein said further processing includes roll forming means forming said bleached web into a roll.

6. The system of claim 1 wherein said preliminary cleaning station includes bale opening apparatus receiving and opening cotton bales, heating apparatus heating said fibers opened from said bales and metal cleaning apparatus removing metal debris from said fibers.

7. The system of claim 1 including a pre-cleaning station arranged between said preliminary cleaning station and said primary cleaning station, said pre-cleaning station acting to pre-clean and further heat said fibers for delivery to said primary cleaning station.

8. The system of claim 1 including a routing system arranged between said preliminary cleaning station and said primary cleaning station, said routing system includes a drying chamber, an opening chamber, and means interconnecting said chambers with said preliminary cleaning station and said primary cleaning station, said interconnecting means including direction valves operative to selectively pass said fibers through selected of said chambers.

9. The system of claim 1 including a fine cleaning station arranged between said primary cleaning station and said bleaching station, said fine cleaning station including a plurality of carding machines arranged side by side, said carding machines being individually connected with a fiber delivery device connected with said primary cleaning station.

10. A continuous fiber processing system for producing blended and bleached cotton fibers comprising:

a preliminary cleaning station comprising opening apparatus, heating apparatus and heavy cleaning apparatus for opening cotton bales, heating cotton fibers separated from said bales and removing metal and large objects from said opened fibers;

second and third cleaning stations connected with said preliminary cleaning station; a bleaching station connected with said second and third cleaning station;

flow control gates arranged between said preliminary cleaning station, said second cleaning station, said third cleaning station and said bleaching station, said flow control gates being operative to selectively deliver said cotton fibers from said preliminary cleaning station between said first and second stations to said bleaching station;

said bleaching station including a web forming station and a bleachery, said web forming station including cleaning, blending and web forming apparatus, said apparatus separating, carding, blending, and forming said fibers into a stable web, said bleachery comprising a plurality of bleaching stations operative to receive said stable fiber web from said web forming section and to bleach said fiber web in a continuous process;

a dryer station receiving said bleached fiber web in a continuous process, said dryer station drying said bleached fiber web;

continuing processing apparatus receiving said dried and bleached web, said continuing processing apparatus acting to further clean and align said fibers and to form a fiber web of bleached, further cleaned and further blended fibers.

11. The system of claim 10 wherein said second cleaning station comprises a plurality of in line inclined cleaners separated by fiber drops and a plurality of comber machines.

12. The system of claim 10 wherein said second cleaning station comprises a plurality of in line condensers separated by a plurality of inclined cleaners.

13. The system of claim 10 wherein said third cleaning station comprises a plurality of carding machines arranged side by side and a delivery system operative to lap the carded fibers for delivery to said bleaching station.

14. The system of claim 10 wherein said web forming section of said bleaching station includes a pair of cross blenders arranged side by side and delivery means adapted to split said fibers received from said second and/or third cleaning station between said cross blenders.

15. The system of claim 14 wherein said web forming section further includes opposed chute feeds connected with opposed carding machines and said cross blenders, said opposed carding machines being interconnected with a cross lapper, a first of said cross blenders delivering cleaned and blended fibers to a first of said chute feeds for delivery to a first of an opposed pair of said carding machines and a second of said cross blenders delivering cleaned and blended fibers to a second of an opposed pair of said carding machines, said cross lapper receiving and lapping carded webs from said first and second carding machines of said opposed pair of carding machines.

16. The system of claim 15 including a conveyer adapted to receive said lapped carded web from said cross lapper, said conveyor delivering said lapped web to said bleachery.

17. The system of claim 16 including web stabilizing apparatus arranged between said cross lapper and said bleachery, said conveyor carrying said lapped and carded web through said stabilizing machine.

18. The system of claim 17 wherein said stabilizing machine comprises a needle punch machine.

19. The system of claim 16 wherein said web forming section includes at least two pair of opposed chute feeds connected with at least two pair of opposed carding machines, each pair of said carding machines being connected with a cross lapper, said cross lappers forming a stacked web on said conveyor.

* * * * *